US011322124B2

(12) United States Patent
Sumi

(10) Patent No.: US 11,322,124 B2
(45) Date of Patent: May 3, 2022

(54) CHORD IDENTIFICATION METHOD AND CHORD IDENTIFICATION APPARATUS

(71) Applicant: Yamaha Corporation, Hamamatsu (JP)

(72) Inventor: Kouhei Sumi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 629 days.

(21) Appl. No.: 16/282,453

(22) Filed: Feb. 22, 2019

(65) Prior Publication Data

US 2019/0266988 A1 Aug. 29, 2019

(30) Foreign Application Priority Data

Feb. 23, 2018 (JP) ..... JP2018-030460

(51) Int. Cl.
*G10H 1/38* (2006.01)

(52) U.S. Cl.
CPC ..... *G10H 1/383* (2013.01); *G10H 2210/056* (2013.01); *G10H 2250/135* (2013.01)

(58) Field of Classification Search
CPC ..... G10H 1/383; G10H 2210/056; G10H 2250/135
USPC ..... 84/613
See application file for complete search history.

(56) References Cited

U.S. PATENT DOCUMENTS 4,966,052 A * 10/1990 Shiraki ..... G10H 1/342 84/723
5,296,644 A 3/1994 Aoki
5,563,361 A * 10/1996 Kondo ..... G10H 1/383 84/613
5,859,381 A * 1/1999 Takahashi ..... G10H 1/36 84/613
6,057,502 A * 5/2000 Fujishima ..... G10H 1/383 84/637
6,448,486 B1 * 9/2002 Shinsky ..... G10H 1/38 84/613
8,338,686 B2 * 12/2012 Mann ..... G06F 3/0481 84/610
10,147,407 B2 * 12/2018 Summers ..... G10H 1/0008
2010/0126332 A1 5/2010 Kobayashi
2010/0305732 A1 * 12/2010 Serletic ..... G06F 3/0481 715/727
2014/0208924 A1 * 7/2014 Aiylam ..... G10H 1/0025 84/613

(Continued)

FOREIGN PATENT DOCUMENTS

CN 113010730 A * 6/2021
JP 5-27767 A 2/1993

(Continued)

OTHER PUBLICATIONS

Japanese-language Office Action issued in Japanese Application No. 2018-030460 dated Dec. 21, 2021 with English translation (eight (8) pages).

*Primary Examiner* — Christina M Schreiber
(74) *Attorney, Agent, or Firm* — Crowell & Moring LLP

(57) ABSTRACT

A chord identification method selects from among a plurality of chord identifiers a chord identifier that corresponds to an attribute of a piece of music represented by an audio signal, where the plurality of chord identifiers corresponds to respective ones of a plurality of attributes relating to pieces of music; and identifies a chord for the audio signal by applying a feature amount of the audio signal to the selected chord identifier.

20 Claims, 2 Drawing Sheets

(56) References Cited

U.S. PATENT DOCUMENTS

| | | | | |
|---|---|---|---|---|
| 2017/0084258 | A1* | 3/2017 | Swiggett | G10H 1/38 |
| 2019/0251941 | A1* | 8/2019 | Sumi | G10H 1/0008 |
| 2019/0266988 | A1* | 8/2019 | Sumi | G10H 1/383 |

FOREIGN PATENT DOCUMENTS

| | | | | | |
|---|---|---|---|---|---|
| JP | 2000-298475 | A | | 10/2000 | |
| JP | 2000298475 | A | * | 10/2000 | G10H 1/383 |
| JP | 2004-302318 | A | | 10/2004 | |
| JP | 2010-122630 | A | | 6/2010 | |
| WO | WO-2017058365 | A1 | * | 4/2017 | G10H 1/0033 |

* cited by examiner

CHORD IDENTIFICATION METHOD AND CHORD IDENTIFICATION APPARATUS

CROSS REFERENCE TO RELATED APPLICATIONS

This application is based on and claims priority from Japanese Patent Application No. 2018-030460, which was filed on Feb. 23, 2018, and the entire contents of which are incorporated herein by reference.

BACKGROUND

Technical Field

This disclosure relates to a technique for identifying a chord (musical chord) from an audio signal representative of singing sounds and/or musical sounds.

Description of Related Art

There has been conventionally proposed a technique for identifying a chord from an audio signal indicative of a waveform representing a mixed sound of singing sounds and musical sounds. For example, Japanese Patent Application Laid-Open Publication No. 2000-298475 (hereafter, JP 2000-298475) discloses a technique for identifying chords from information of a musical sound waveform. Chords are identified by use of a pattern matching method, which involves comparing frequency spectrum information of chord patterns that are prepared in advance.

Chords used in a piece of music vary depending on an attribute (for example, an attribute related to a genre) of the piece of music. Specifically, depending on an attribute of a piece of music, certain chords are more likely to appear than other chords. In the technique disclosed in JP 2000-298475, an attribute of a piece of music is not taken into account. As a result, the technique suffers from a drawback in that it is not always possible to identify an appropriate chord.

SUMMARY

Accordingly, an object of the present invention is to identify an appropriate chord suited to an attribute of a piece of music.

In one aspect, a chord identification method in accordance with some embodiments may include: selecting from among a plurality of chord identifiers a chord identifier that corresponds to an attribute of a piece of music represented by an audio signal, where the plurality of chord identifiers corresponds to respective ones of a plurality of attributes of pieces of music; and identifying a chord for the audio signal by applying a feature amount of the audio signal to the selected chord identifier.

In another aspect, a chord identification apparatus in accordance with some embodiments may include a processor configured to execute stored instructions to: select from among a plurality of chord identifiers a chord identifier that corresponds to an attribute of a piece of music represented by an audio signal, where the plurality of chord identifiers corresponds to respective ones of a plurality of attributes of pieces of music; and identify a chord for the audio signal by applying a feature amount of the audio signal to the selected chord identifier.

DESCRIPTION OF THE EMBODIMENTS

Figure 1:
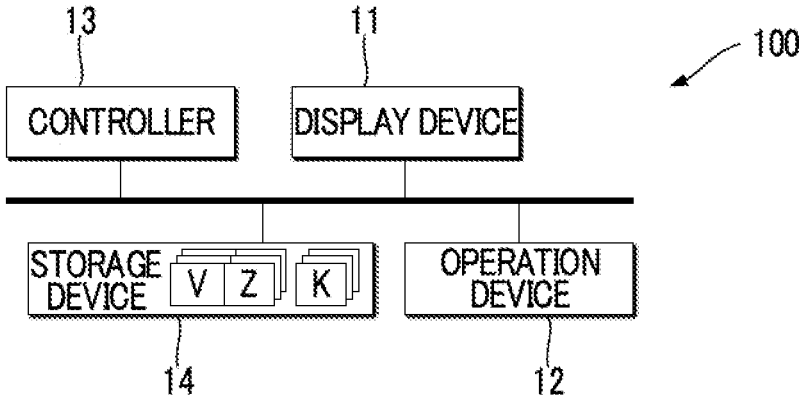
FIG. 1 is a block diagram illustrating a configuration of a chord identification apparatus according to an embodiment.

FIG. 1 is a block diagram illustrating a configuration of a chord identification apparatus 100 according to a preferred embodiment. The chord identification apparatus 100 is a computer system that identifies a chord X for an audio signal V representative of a performance sound (for example, a singing sound, a musical sound, or the like), and includes a display device 11, an operation device 12, a controller 13, and a storage device 14. For example, a portable information terminal such as a portable phone and a smartphone, or a portable or stationary information terminal such as a personal computer may be preferably used as the chord identification apparatus 100.

The display device 11 (for example, a liquid crystal display panel) displays various images under control of the controller 13. The display device 11 displays a time series of chords X identified from an audio signal V. The operation device 12 is an input device that receives an instruction from a user. For example, multiple operators operable by a user or a touch panel that detects contact by the user with the display surface of the display device 11 may be preferably used as the operation device 12.

The controller 13 is processing circuitry such as a CPU (Central Processing Unit), and integrally controls elements that form the chord identification apparatus 100. The controller 13 identifies a chord X for an audio signal V stored in the storage device 14. The chord X is determined depending on the content of the audio signal V.

The storage device 14 may be, for example, a known recording medium such as a magnetic recording medium and a semiconductor recording medium, or a combination of various types of recording media, and stores programs to be executed by the controller 13 and various data to be used by the controller 13. The storage device 14 according to the present embodiment stores audio signals V corresponding to pieces of music. Each audio signal V is associated with data Z representing an attribute (hereinafter referred to as "attribute data") of a piece of music represented by each audio signal V. The attribute of a piece of music is information indicating characteristics and properties of the piece of music. In the present embodiment, an attribute related to a genre of a piece of music (for example, rock, pop, hardcore, or the like) is a non-limiting example of an attribute of a piece of music. In one embodiment, the storage device 14 (for example, a cloud storage) separate from the chord identification apparatus 100 may be prepared, such that the controller 13 writes or reads data into or from the storage device 14 via a mobile communication network or via a communication network such as the Internet. The storage device 14 may be omitted from the chord identification apparatus 100 when thus configured.

Figure 2:
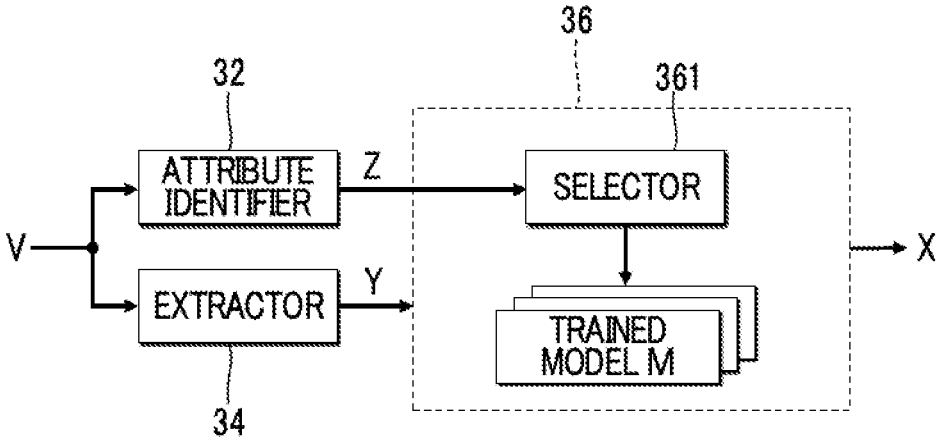
FIG. 2 is a block diagram illustrating a functional configuration of the chord identification apparatus.

FIG. 2 is a block diagram illustrating a functional configuration of the controller 13. The controller 13 executes a program stored in the storage device 14 to thereby implement multiple functions (an attribute identifier 32, an extractor 34, and an analyzer 36) for identifying time-series chords X for the audio signals V. In one embodiment, the functions of the controller 13 may be implemented by a set of multiple devices (i.e., a system); or part or all of the functions of the controller 13 may be implemented by dedicated electronic circuitry (for example, by signal processing circuitry).

A user operates the operation device 12 to select an audio signal V to be processed from among audio signals V stored in the storage device 14. The attribute identifier 32 identifies an attribute of a piece of music represented by the selected audio signal V. Specifically, the attribute identifier 32 reads attribute data Z that is associated with the audio signal V from the storage device 14 to identify the attribute.

The extractor 34 extracts, from an audio signal V to be processed, feature amounts Y of the audio signal V. A feature amount Y is extracted for each unit period. The unit period is, for example, a period corresponding to one beat of a piece of music. That is, feature amounts Y in time series are generated from the audio signal V. The feature amount Y for each unit period is an indicator of a sound characteristic of a portion corresponding to each unit period in the audio signal V. In one embodiment, the feature amount Y may be a Chroma vector (PCP: Pitch Class Profile) including an element for each of pitch classes (for example, the twelve half tones of the 12 tone equal temperament scale). An element corresponding to a pitch class in the Chroma vector is set to an intensity obtained by adding up the intensity of a component corresponding to the pitch class in the audio signal V over a plurality of octaves.

The analyzer 36 includes multiple trained models M, with each trained model being an example of a chord identifier, where each trained model is used for identifying a chord X based on a feature amount Y of the audio signal V. Each trained model M corresponds to one of various attributes relating to a piece of music (for example, rock, pop, hardcore, or the like). The analyzer 36 includes a selector 361 that selects a trained model M that corresponds to an attribute (i.e., the attribute of a piece of music represented by the audio signal V) identified by the attribute identifier 32 from among the trained models M. The analyzer 36 identifies a chord X for an audio signal V to be processed, using the trained model M selected by the selector 361 Specifically, the analyzer 36 identifies the chord X by feeding the feature amount Y extracted by the extractor 34 to the trained model M selected by the selector 361. The analyzer 36 identifies a chord X for each of feature amounts Y extracted by the extractor 34. That is, chords X for an audio signal V are identified in time series. The display device 11 displays the series of chords X identified by the analyzer 36.

The trained model M is a statistical model that has learned relationships between feature amounts Y and chords X of audio signals V, and is defined by multiple coefficients K. The trained model M outputs a chord X when a feature amount Y extracted by the extractor 34 is fed thereto. In one embodiment, a neural network (typically, a deep neural network) may be preferably used as the trained model M. The coefficients K of a trained model M corresponding to one attribute are set by machine learning using Q pieces of training data L relating to the attribute.

Figure 3:
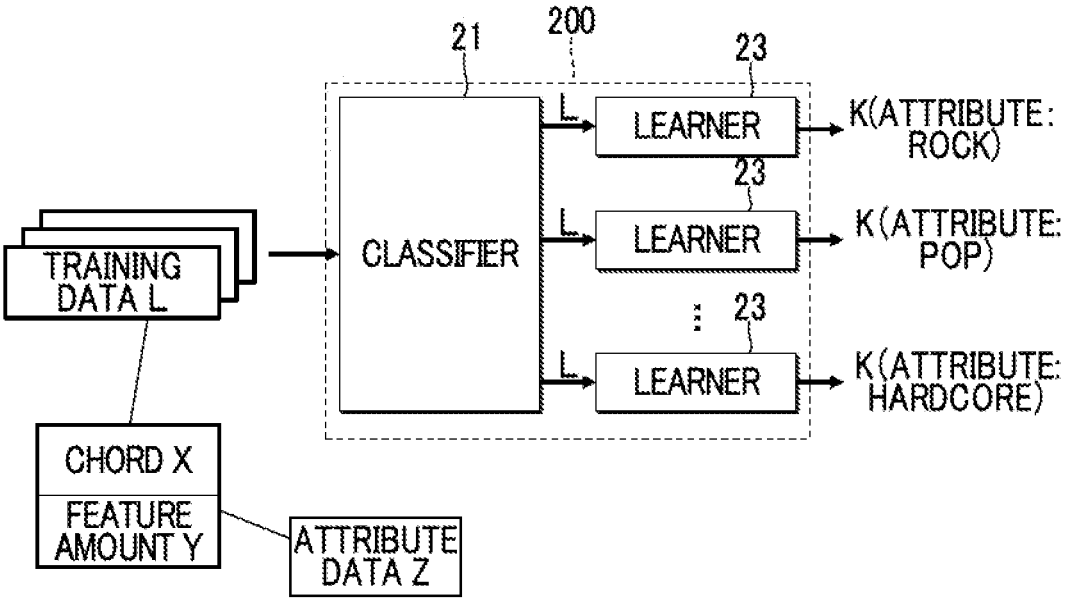
FIG. 3 is a block diagram illustrating a functional configuration of a machine learning apparatus.

FIG. 3 is a block diagram illustrating a configuration of a machine learning apparatus 200 for setting coefficients K. The machine learning apparatus 200 is a computer system including a classifier 21 and learners 23. The classifier 21 and learners 23 each are implemented by a controller (not shown), such as a CPU (Central Processing Unit). In one embodiment, the machine learning apparatus 200 may be mounted on the chord identification apparatus 100. Each of the Q pieces of training data L consists of a combination of a chord X and a feature amount Y of the chord X. Attribute data Z is associated with training data L.

The classifier 21 classifies N pieces (Q<N) of training data L into different attributes. Specifically, the classifier 21 divides the N pieces of training data L into groups so that training data L having the same attribute data Z are in the same group. The learners 23 have a one-to-one correspondence with an attribute (for example, rock, pop, hardcore, or the like). Each learner 23 generates multiple coefficients K that define a trained model M for an attribute corresponding to each learner 23 by machine learning (deep learning) using Q pieces of training data L classified to the attribute. Each set of coefficients K generated for a corresponding attribute is stored in the storage device 14. As will be understood from the above description, a trained model M corresponding to a particular attribute learns relationships between feature amounts Y and chords X of audio signals V representative of pieces of music having a particular attribute. Accordingly, with a feature amount Y being fed to a trained model M corresponding to a particular attribute, the trained model M outputs a chord X that is adequate for the fed feature amount Y for a piece of music having the particular attribute.

Figure 4:
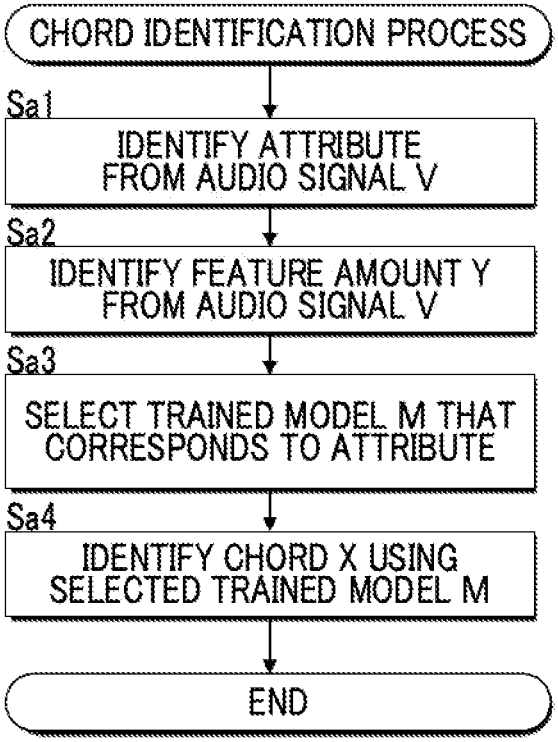
FIG. 4 is a flowchart illustrating a chord identification process.

FIG. 4 is a flowchart illustrating a process of identifying a chord X for an audio signal V (hereafter, a "chord identification process"), where the process is performed by the controller 13 of the chord identification apparatus 100. The chord identification process is started upon receiving an instruction from a user, for example. When the chord identification process is started, the attribute identifier 32 identifies an attribute of a piece of music represented by an audio signal V to be processed (Sa1). The extractor 34 extracts a feature amount Y for each unit period of the audio signal V to be processed (Sa2). The selector 361 selects a trained model M corresponding to the attribute identified by the attribute identifier 32 from among the trained models M (Sa3). In one embodiment, the process of Step Sa3 may be executed before the process of Step Sa2. The analyzer 36 identifies a chord X for each unit period by feeding each feature amount Y for the unit period extracted by the extractor 34 to the trained model M selected by the selector 361 (Sa4).

As described in the foregoing, a trained model M corresponding to an attribute of a piece of music represented by an audio signal V to be processed is used to identify a chord X for the audio signal V. Accordingly, a chord X suited to the attribute of a piece of music can be identified, which would not be possible if a chord X were to be identified by a same trained model M, regardless of the attribute.

In particular, in the present embodiment, a chord X is identified by a trained model M that has learned relationships between feature amounts Y and chords X of audio signals V. The configuration according to the present embodiment hence has an advantage that chords X can be highly precisely identified from a variety of feature amounts Y of audio signals V compared with a configuration in which a chord X is identified by comparing the feature amount Y of an audio signal V with chords X prepared in advance. A trained model M is generated by machine learning using multiple pieces of training data L for an attribute, and therefore, a chord X can be appropriately identified in line with chords that tend to be used in pieces of music having that particular attribute.

Modifications

The embodiment described above may be modified in various ways as follows. Two or more modifications selected from the following may be appropriately combined unless they contradict to each other.

(1) The chord identification apparatus 100 may be a server apparatus that communicates with a terminal apparatus (for example, a portable phone or a smartphone) via a mobile communication network or via a communication network such as the Internet. Such a terminal apparatus transmits, to the chord identification apparatus 100, an audio signal V and an attribute associated thereto. The chord identification apparatus 100 performs the chord identification process on the audio signal V transmitted from the terminal apparatus to identify a chord X based on the audio signal V and the attribute thereof, and transmits the identified chord X to the terminal apparatus. In one embodiment, the terminal apparatus may additionally transmit the feature amounts Y of the audio signal V to the chord identification apparatus 100. In this case, the extractor 34 may be omitted from the chord identification apparatus 100.

(2) In the above-described embodiment, an attribute related to a genre of a piece of music is used an example of an attribute. However, an attribute is not limited thereto. For example, an attribute may be a performer (an artist) who played a piece of music, a period or era when a piece of music was composed, or the like.

(3) In the above-described embodiment, an attribute is identified by reading the attribute data Z stored in the storage device 14, but an attribute may be identified in a different manner. For example, the attribute identifier 32 may identify an attribute of a piece of music represented by an audio signal V by analyzing the audio signal V stored in the storage device 14. For example, the attribute identifier 32 identifies an attribute related to a genre of a piece of music by analyzing the audio signal V. A known technique may be adopted for identification of the attribute related to a genre. Such a configuration has an advantage in that a user does not need to specify the attribute of a piece of music represented by an audio signal V to be processed.

(4) In the above-described embodiment, the analyzer 36 identifies a chord X using one of trained models M, each corresponding to respective ones of different attributes, but a chord X may be identified in a different manner. For example, a chord X may be identified using one of reference tables, each corresponding to respective ones of various attributes. Each reference table is a data table in which each of various chords X is associated with a corresponding feature amount Y. The selector 361 selects from among the reference tables a reference table that corresponds to an attribute identified by the attribute identifier 32; and the analyzer 36 identifies a chord X that corresponds to a feature amount Y that is the closest to the feature amount Y extracted by the extractor 34 from among the feature amounts Y registered in the reference table selected by the selector 361.

An element for identifying the chord X based on the feature amount Y of the audio signal V is generally referred to as a "chord identifier." Thus, the chord identifier is a concept encompassing the trained model M described in the embodiment and the above-described reference table. In a case where the chord identifier is a trained model M, the analyzer 36 may identify a chord for an audio signal V by inputting (feeding) the feature amount of the audio signal V to the chord identifier (the trained model M). In a case where the chord identifier is a reference table, the analyzer 36 may refer to the selected chord identifier (reference table) to identify a chord that corresponds to the feature amount of an audio signal V.

(5) In the above-described embodiment, the Chroma vector is given as an example of the feature amount Y of an audio signal V, but the feature amount Y is not limited thereto. For example, the frequency spectrum of an audio signal V may be employed as the feature amount Y.

(6) In the above-described embodiment, the neural network is given as an example of the trained model M, but the trained model M is not limited thereto. For example, an SVM (Support Vector Machine) or an HMM (Hidden Markov Model) may be used as the trained model M.

(7) The above-described embodiment employs a trained model M that outputs a chord X when a feature amount Y is fed, but the trained model M may employ a different property. For example, a trained model M used may be one that outputs the occurrence probability for each chord X when a feature amount Y is fed. The analyzer 36 then identifies a chord X having the maximum occurrence probability. Alternatively, the analyzer 36 may identify plural chords X from a highest order of occurrence probabilities.

(8) The chord identification apparatus 100 and the machine learning apparatus 200 according to the above-described embodiment and modifications are realized by a computer (specifically, a controller) and a program working in coordination with each other, as shown in the embodiment and modifications. A program according to the above-described embodiment and modifications may be provided in the form of being stored in a computer-readable recording medium, and installed on a computer. The recording medium is, for example, a non-transitory recording medium, and is preferably an optical recording medium (optical disc) such as CD-ROM or the like. However, the recording medium may include any type of known recording medium such as a semiconductor recording medium, a magnetic recording medium, or the like. The non-transitory recording medium may be a freely-selected recording medium other than the transitory propagating signal, and does not exclude a volatile recording medium. Alternatively, the program may be provided by being distributed via a communication network for installation on a computer. An element for executing the program is not limited to a CPU, and may instead be a processor for a neural network such as a tensor processing unit or a neural engine, or a DSP (Digital Signal Processor) for signal processing. The program may be executed by multiple elements working in coordination with each other, where the elements are selected from among those described in the above embodiments.

(9) The trained model M is a statistical model (for example, a neural network) that is implemented by a controller (one example of a computer), and generates an output B corresponding to an input A. Specifically, the trained model M is realized by a combination of a program (for example, program modules making up the artificial intelligence software) and coefficients applied to a computation which the controller is caused to execute for identifying the output B from the input A. Multiple coefficients of the trained model M are optimized through a machine learning (deep learning) process using multiple pieces of training data L, in each piece of which an input A and an output B are associated. That is, the trained model M is a statistical model that has learned relationships between inputs A and outputs B. The controller performs a computation on an unknown input A by applying the learned coefficients and a predetermined response function, to generate an adequate output B, relative to the input A, that is determined based on the tendency learned from the multiple pieces of training data L (relationships between inputs A and outputs B).

(10) The following aspects are derivable from the above-described embodiments and modifications.

In one aspect (first aspect), a chord identification method is a method implemented by a computer and selects from among a plurality of chord identifiers a chord identifier that corresponds to an attribute of a piece of music represented by an audio signal, where the plurality of chord identifiers corresponds to respective ones of a plurality of attributes relating to pieces of music; and identifies a chord for the audio signal by applying a feature amount of the audio signal to the selected chord identifier. According to the first aspect, the chord for an audio signal is identified by using a chord identifier corresponding to the attribute of a piece of music represented by the audio signal, and therefore, the appropriate chord for the attribute of a piece of music can be identified. This would not be possible if the chord were to be identified by a same chord identifier, regardless of the attribute.

The chord identifier may be a trained model or a reference table. In a case where the chord identifier is a trained model, "identifying a chord for the audio signal by applying a feature amount of the audio signal to the selected chord identifier" may include identifying a chord for an audio signal by inputting (feeding) the feature amount of the audio signal to the chord identifier. In a case where the chord identifier is a reference table, "identifying a chord for the audio signal by applying a feature amount of the audio signal to the selected chord identifier" may include referring to the selected chord identifier (reference table) to identify a chord that corresponds to the feature amount of the audio signal.

In an example (second aspect) of the first aspect, each of the plurality of chord identifiers is a trained model that has learned relationships between feature amounts and chords of audio signals. According to the second aspect, the chord is identified by a trained model that has learned relationships between feature amounts and chords of audio signals. Accordingly, the chord can be identified from a variety of feature amounts of the audio signals with a higher accuracy compared with a configuration in which the chord is identified by comparing the feature amount of the audio signal with chords prepared in advance, for example.

In an example (third aspect) of the second aspect, each of the plurality of chord identifiers may be generated by machine learning using a plurality of pieces of training data for an attribute that corresponds to each chord identifier from among the plurality of the attributes. According to the third aspect, the chord identifier is generated by machine learning using a plurality of pieces of training data for an attribute corresponding to the chord identifier, and therefore, the chord can be appropriately identified in line with the chords that tend to be used in pieces of music having that particular attribute.

In an example (fourth aspect) of any one of the first aspect to the third aspect, the chord identification method may further include: receiving the audio signal from a terminal apparatus; and transmitting the identified chord to the terminal apparatus. In this case, selecting the chord identifier includes selecting a chord identifier that corresponds to an attribute of a piece of music represented by the received audio signal; and identifying the chord includes identifying a chord for the received audio signal based on a feature amount of the received audio signal and the selected chord identifier. According to the fourth aspect, a processing load on the terminal apparatus is reduced as compared with a method of identifying a chord by a chord identifier that is mounted on a terminal apparatus of a user, for example.

In an example (fifth aspect) of the first aspect, the audio signal may be selected by a user of a terminal apparatus, and the attribute of the piece of music represented by the audio signal may be identified by attribute data that is associated with the audio signal selected by a user from among attribute data stored in association with audio signals. According to the fifth aspect, a processing load on a terminal apparatus or a server apparatus can be reduced compared with a method of identifying an attribute by analyzing an audio signal, for example.

In an example (sixth aspect) of the first aspect, the attribute of the piece of music represented by the audio signal may be identified by analyzing the audio signal. According to the sixth aspect, the storage space taken up at a terminal apparatus or a server apparatus can be reduced compared with a case in which an attribute is identified from attribute data stored in association with an audio signal.

In another aspect (seventh aspect), a chord identification apparatus includes a processor configured to execute stored instructions to: select from among a plurality of chord identifiers a chord identifier that corresponds to an attribute of a piece of music represented by an audio signal, where the plurality of chord identifiers corresponds to respective ones of a plurality of attributes relating to pieces of music; and identify a chord for the audio signal by applying a feature amount of the audio signal to the selected chord identifier. According to the seventh aspect, the chord for an audio signal is identified by the chord identifier corresponding to the attribute of a piece of music represented by the audio signal, and therefore, the appropriate chord for the attribute of the piece of music can be identified, in contrast to a configuration in which the chord is identified by a same chord identifier regardless of an attribute.

DESCRIPTION OF REFERENCE SIGNS

100 . . . chord identification apparatus, 200 . . . machine learning apparatus, 11 . . . display device, 12 . . . operation device, 13 . . . controller, 14 . . . storage device, 21 . . . classifier, 23 . . . learner, 32 . . . attribute identifier, 34 . . . extractor, 36 . . . analyzer, 361 . . . selector

What is claimed is:

1. A computer-implemented chord identification method comprising:

selecting, from among a plurality of chord identifiers, a chord identifier that corresponds to an attribute of a piece of music represented by an audio signal, where the plurality of chord identifiers corresponds to respective ones of a plurality of attributes relating to pieces of music, the plurality of attributes including music genres; and identifying, by the selected chord identifier, a chord for the audio signal based on a feature amount of the audio signal, the feature amount including an indicator of a sound characteristic of the audio signal.

2. The chord identification method according to claim 1, wherein each of the plurality of chord identifiers is a trained model, which is trained based on machine learning, that has learned relationships between feature amounts and chords of audio signals.

3. The chord identification method according to claim 2, wherein each of the plurality of chord identifiers is generated by the machine learning using a plurality of pieces of training data for an attribute that corresponds to each chord identifier from among the plurality of the attributes.

4. The chord identification method according to claim 1, further comprising:

receiving the audio signal from a terminal apparatus; and transmitting the identified chord to the terminal apparatus, wherein selecting the chord identifier includes selecting a chord identifier that corresponds to an attribute of a piece of music represented by the received audio signal, and wherein identifying the chord includes identifying a chord for the received audio signal by applying the feature amount of the received audio signal to the selected chord identifier.

5. The chord identification method according to claim 1, wherein the audio signal is selected by a user of a terminal apparatus, and the attribute of the piece of music represented by the audio signal is identified by attribute data that is associated with the audio signal selected by a user from among attribute data stored in association with audio signals.

6. The chord identification method according to claim 1, wherein the attribute of the piece of music represented by the audio signal is identified by analyzing the audio signal.

7. The chord identification method according to claim 1, wherein the plurality of attributes further includes a performer of the piece of music and a period or era when the piece of music was composed.

8. A chord identification apparatus comprising:

a processor configured to execute stored instructions to:

select from among a plurality of chord identifiers a chord identifier that corresponds to an attribute of a piece of music represented by an audio signal, where the plurality of chord identifiers corresponds to respective ones of a plurality of attributes relating to pieces of music, the plurality of attributes including music genres; and identify, by the selected chord identifier, a chord for the audio signal based on a feature amount of the audio signal, the feature amount including an indicator of a sound characteristic of the audio signal.

9. The chord identification apparatus according to claim 8, wherein each of the plurality of chord identifiers is a trained model, which is trained based on machine learning, that has learned relationships between feature amounts and chords of audio signals.

10. The chord identification apparatus according to claim 9, wherein each of the plurality of chord identifiers is generated by the machine learning using a plurality of pieces of training data for an attribute that corresponds to each chord identifier from among the plurality of the attributes.

11. The chord identification apparatus according to claim 8, wherein the processor is further configured to execute the stored instructions to:

receive the audio signal from a terminal apparatus; and transmit the identified chord to the terminal apparatus, wherein in selecting the chord identifier, the processor is configured to select a chord identifier that corresponds to the attribute of the piece of music represented by the received audio signal, and wherein in identifying the chord, the processor is configured to identify a chord for the received audio signal by applying the feature amount of the received audio signal to the selected chord identifier.

12. The chord identification apparatus according to claim 8, wherein the audio signal is selected by a user of a terminal apparatus, and the attribute of the piece of music represented by the audio signal is identified by attribute data that is associated with the audio signal selected by a user from among attribute data stored in association with audio signals.

13. The chord identification apparatus according to claim 8, wherein the attribute of the piece of music represented by the audio signal is identified by analyzing the audio signal.

14. The chord identification apparatus according to claim 8, wherein the processor is further configured to execute stored instructions to identify the plurality of attributes including the music genres by analyzing the audio signal.

15. The chord identification apparatus according to claim 8, wherein the plurality of attributes relating to pieces of music further includes a performer of the piece of music and a period or era when the piece of music was composed.

16. A computer-implemented chord identification method comprising:

selecting, from among a plurality of chord identifiers, a chord identifier that corresponds to an attribute of a piece of music represented by an audio signal, where the plurality of chord identifiers corresponds to respective ones of a plurality of attributes relating to pieces of music, the plurality of attributes including information related to music genres; and identifying, by the selected chord identifier, a chord for the audio signal based on a feature amount of the audio signal, the feature amount including an indicator of a sound characteristic of the audio signal.

17. The chord identification method according to claim 16, further comprising:

identifying the plurality of attributes related to the music genres by analyzing the audio signal.

18. The chord identification method according to claim 16, wherein each of the plurality of chord identifiers is a trained model, which is trained based on machine learning, that has learned relationships between feature amounts and chords of audio signals.

19. The chord identification method according to claim 18, wherein each of the plurality of chord identifiers is generated by the machine learning using a plurality of pieces of training data for an attribute that corresponds to each chord identifier from among the plurality of the attributes.

20. The chord identification method according to claim 16, further comprising:

receiving the audio signal from a terminal apparatus; and transmitting the identified chord to the terminal apparatus, wherein selecting the chord identifier includes selecting a chord identifier that corresponds to an attribute of a piece of music represented by the received audio signal, and wherein identifying the chord includes identifying a chord for the received audio signal by applying the feature amount of the received audio signal to the selected chord identifier.

* * * * *